US005960725A

United States Patent [19]

Tseng

[11] Patent Number: 5,960,725

[45] Date of Patent: Oct. 5, 1999

[54] ROTARY NEEDLE DRIVING MECHANISM FOR A SEWING MACHINE

[76] Inventor: Hsien Chang Tseng, 9F., No. 270, Gau Gong Road, Taichung, Taiwan

[21] Appl. No.: 09/006,608

[22] Filed: Jan. 13, 1998

[51] Int. Cl.[6] ..... D05B 57/30

[52] U.S. Cl. ..... 112/100; 112/221

[58] Field of Search ..... 112/220, 221, 112/166, 199, 100, 475.26

[56] References Cited

U.S. PATENT DOCUMENTS

| | | | |
|---|---|---|---|
| 1,046,401 | 12/1912 | Onderdonk | 112/100 |
| 1,213,449 | 1/1917 | Berger, Jr. | 112/100 |
| 1,280,680 | 10/1918 | De Voe | 112/100 |
| 1,365,238 | 1/1921 | Gatchell | 112/100 |
| 2,824,531 | 2/1958 | Bruel et al. | 112/100 |
| 4,884,518 | 12/1989 | Mori | 112/199 |
| 5,383,414 | 1/1995 | Winter et al. | 112/100 |

*Primary Examiner*—Ismael Izaguirre
*Attorney, Agent, or Firm*—Charles E. Baxley, Esq.

[57] ABSTRACT

A driving mechanism for a sewing machine includes a rotatable shaft coupled to one or more needles for moving the needles upward and downward in a reciprocating action. A rotary looper is rotatably secured to the sewing machine at a vertical axle and is coupled to the shaft for allowing the shaft to actuate the needles and the rotary looper simultaneously. A rod is vertically secured in the sewing machine and coupled to the rotary looper for rotating the rotary looper. Two bevel gears are secured to the rod and the shaft for allowing the shaft to rotate the vertical rod.

2 Claims, 6 Drawing Sheets

ROTARY NEEDLE DRIVING MECHANISM FOR A SEWING MACHINE

BACKGROUND OF THE INVENTION

1. Field of the Invention

The present invention relates to a sewing machine, and more particularly to a sewing machine having a driving mechanism provided for rotating and driving the rotary looper.

2. Description of the Prior Art

Typical sewing machines comprise various kinds of needles and/or loopers that are driven by different driving systems or mechanisms such that the operating timing between the needles and/or loopers may not be easily calibrated.

The present invention has arisen to mitigate and/or obviate the afore-described disadvantages of the conventional sewing machines.

SUMMARY OF THE INVENTION

The primary objective of the present invention is to provide a sewing machine which includes a driving shaft that may be used for simultaneously driving the needles and the rotary looper.

In accordance with one aspect of the invention, there is provided a driving mechanism for a sewing machine, the driving mechanism being disposed in an arm of the sewing machine, the driving mechanism comprising a shaft for rotatably securing in the arm of the sewing machine, at least one needle for slidably securing in the arm and adapted to be moved upward and downward, a rotary looper for rotatably coupling to the sewing machine at a vertical axle, the rotary looper being allowed to be rotated about the axle, a first coupling means for coupling the needle to the shaft, for moving the needle upward and downward, and a second coupling means for coupling the rotary looper to the shaft, for rotating the shaft about the axle. The needle and the rotary looper are allowed to be actuated by the shaft simultaneously.

The second coupling means includes a frame for securing to the sewing machine and for rotatably supporting the axle, a rod for vertically and rotatably securing to the sewing machine, a third coupling means for coupling the rod to the axle, and means for rotating the rod, the rotary looper is allowed to be rotated by the rotating means via the rod and the third coupling means.

The third coupling means includes a follower secured to the rod and rotated in concert with the rod, a stick secured to the axle, and a link pivotally coupling the follower to the stick for allowing the axle to be actuated by the rod.

The rotating means includes a first bevel gear secured to the rod, and a second bevel gear secured to the shaft and engaged with the first bevel gear, for allowing the rod to be rotated by the shaft via the first bevel gear and the second bevel gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
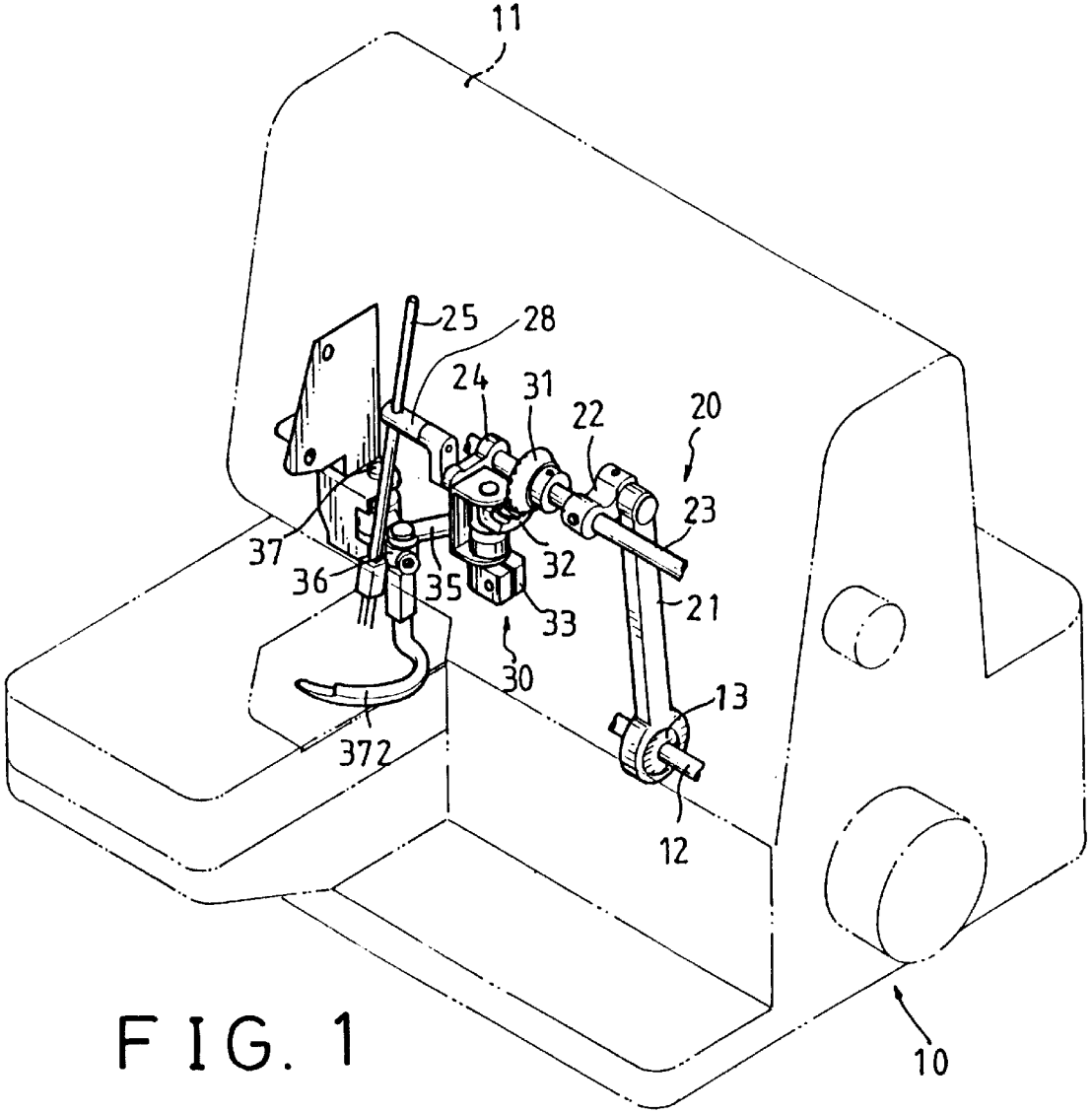
FIG. 1 is a perspective view of a rotary looper driving mechanism for a sewing machine in accordance with the present invention.
Figure 2:
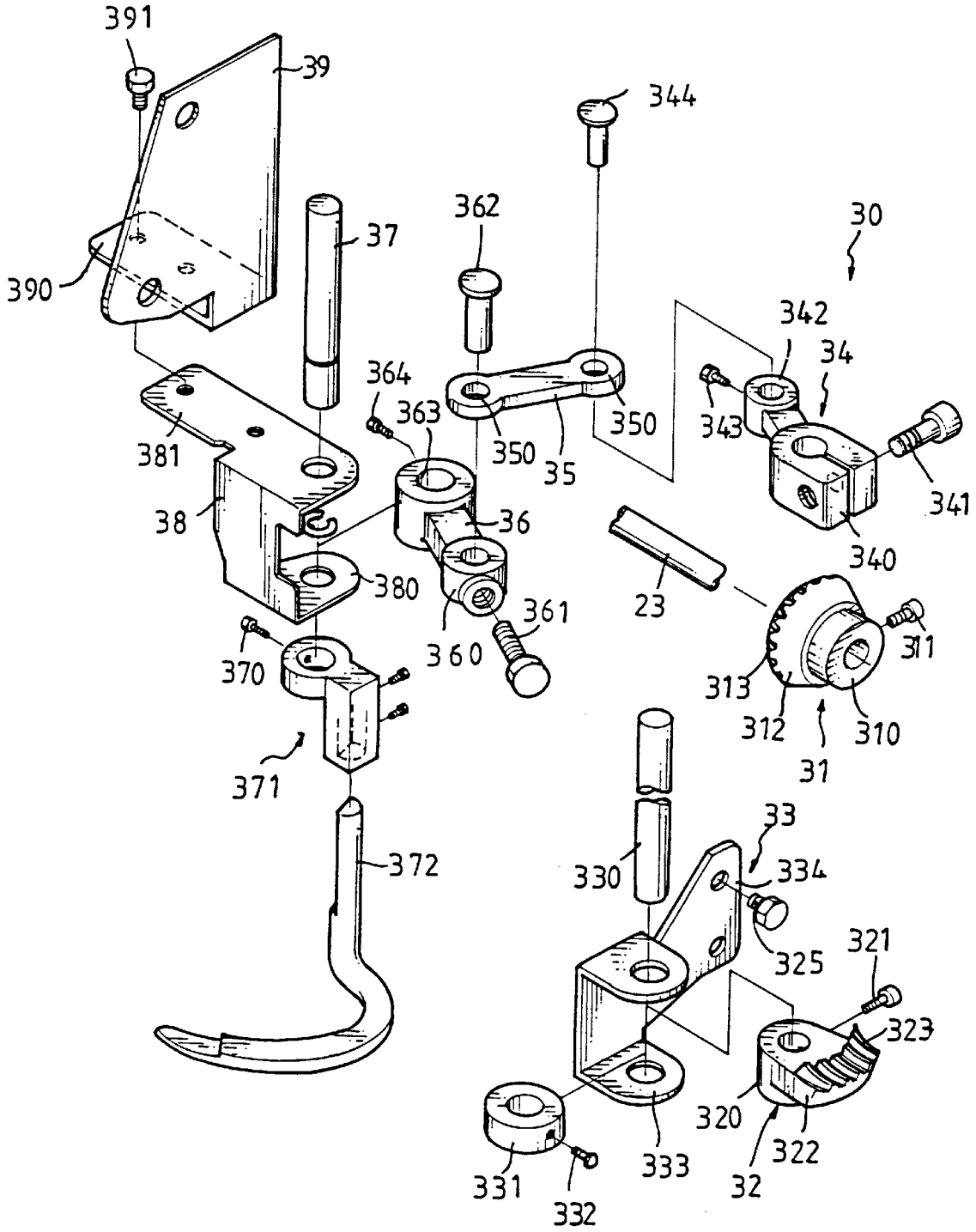
FIG. 2 is an exploded view of the driving mechanism.
Figure 3:
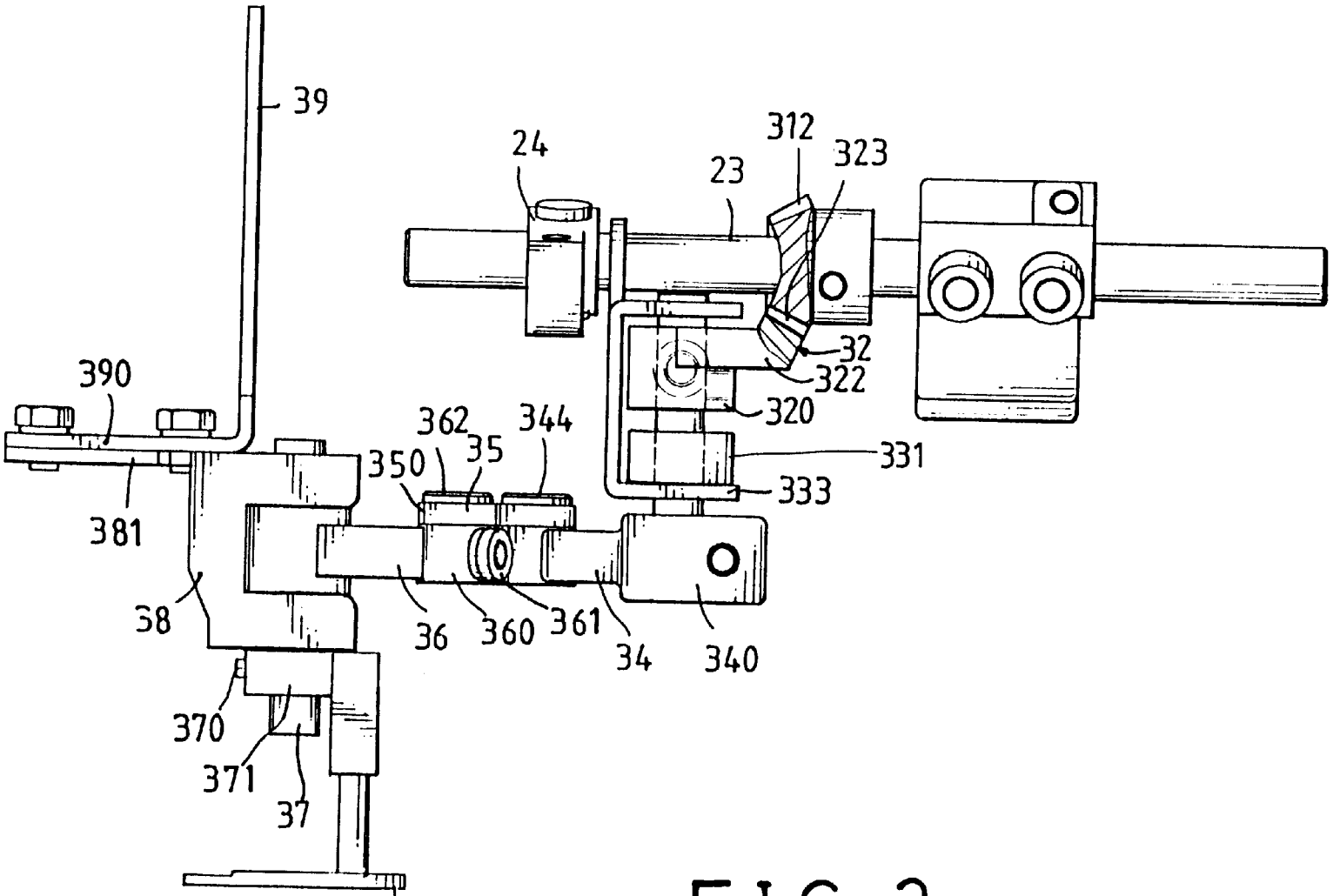
FIG. 3 is a front view of the driving mechanism.
Figure 7:
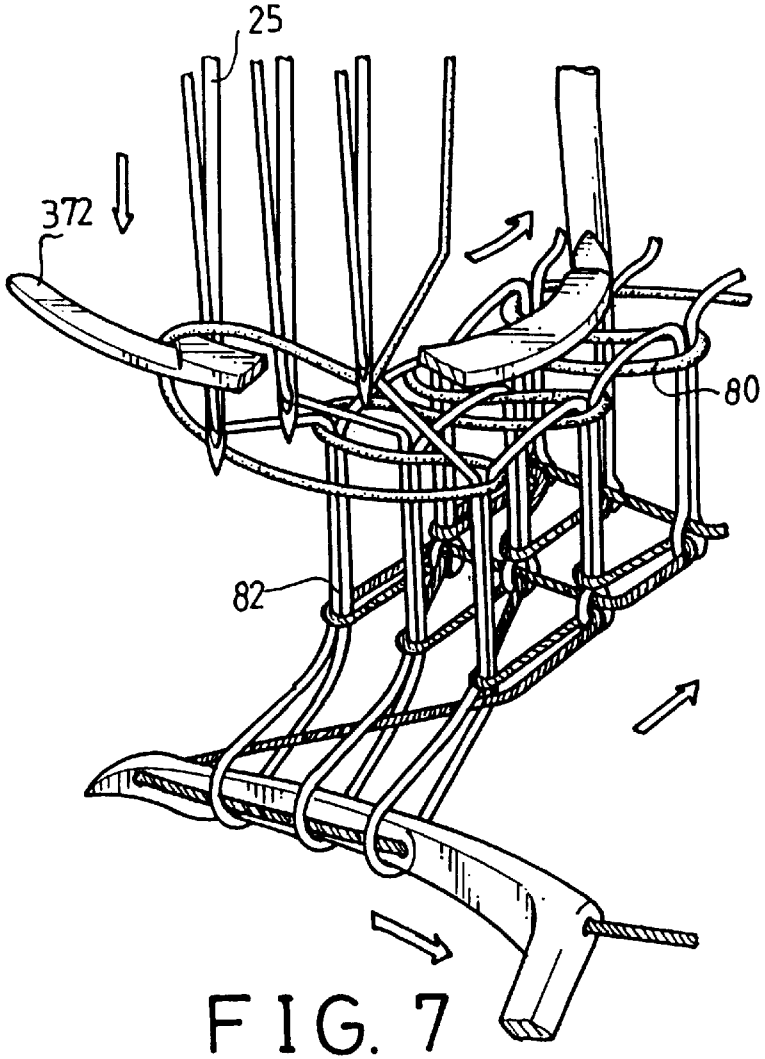
FIG. 7 is a partial perspective view illustrating the operation of the rotary looper.
Figure 4:
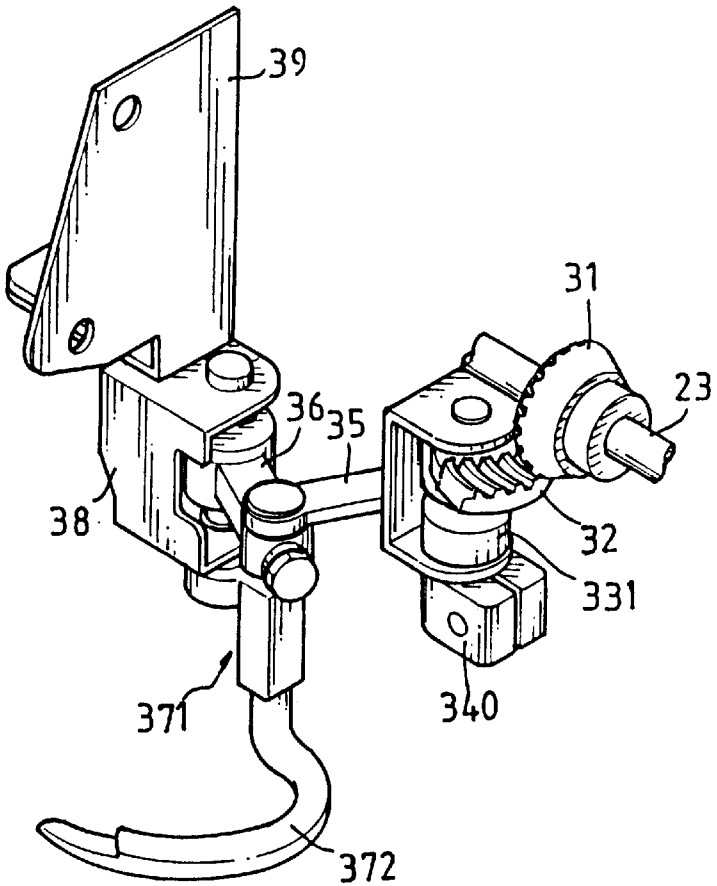
FIG. 4 is a partial perspective view of the driving mechanism.

Referring to the drawings, and initially to FIG. 1, a rotary looper driving mechanism for a sewing machine in accordance with the present invention is disposed in the arm 11 of the sewing machine 10. The sewing machine 10 includes a spindle 12 rotatably disposed in the bottom portion of the sewing machine and coupled to a motor for allowing the motor to drive and to rotate the spindle 12. A driving shaft 23 is rotatably disposed in the arm 11 of the sewing machine 10. A bar 22 has one end secured to the driving shaft 23 and has the other end pivotally coupled to the spindle 12 via a beam 21 and a cam or eccentric member 13, for allowing the driving shaft 23 to be rotated or swung by the spindle 12. Another bar 24 has one end secured to the driving shaft 23 and has the other end pivotally coupled to the needle 25 via a coupler 28 for allowing the driving shaft 23 to move the needle 25 upward and downward in a reciprocating action. The movement of the needle 25 by the driving shaft 23 is typically seen in the typical sewing machines and will not be described in further details hereinafter.

As shown in FIGS. 1–4, a bevel gear 31 includes one end 310 secured to the driving shaft 23 by a fastener 311 and includes the other end 312 having a number of teeth 313. A bracket 33 has one end 334 secured to the arm 11 of the sewing machine 10 by one or more fasteners 325 and has a pair of ears 333 for rotatably engaging with a rod 330. A collar 331 is secured to the rod 330 by a fastener 332 and disposed between the ears 333 for rotatably securing the rod 330 to the bracket 33. Another bevel gear 32 has one end 320 secured to the rod 330 by a fastener 321 and has a number of teeth 323 provided on the other end 322 for engaging with the teeth 313 of the bevel gear 31 and for allowing the driving shaft 23 to drive and rotate the rod 330 via the bevel gears 31, 32. A follower 34 has one end 340 secured to the rod 330 by a fastener 341 and has the other end 342 secured to a pin 344 by a fastener 343.

Figure 5:
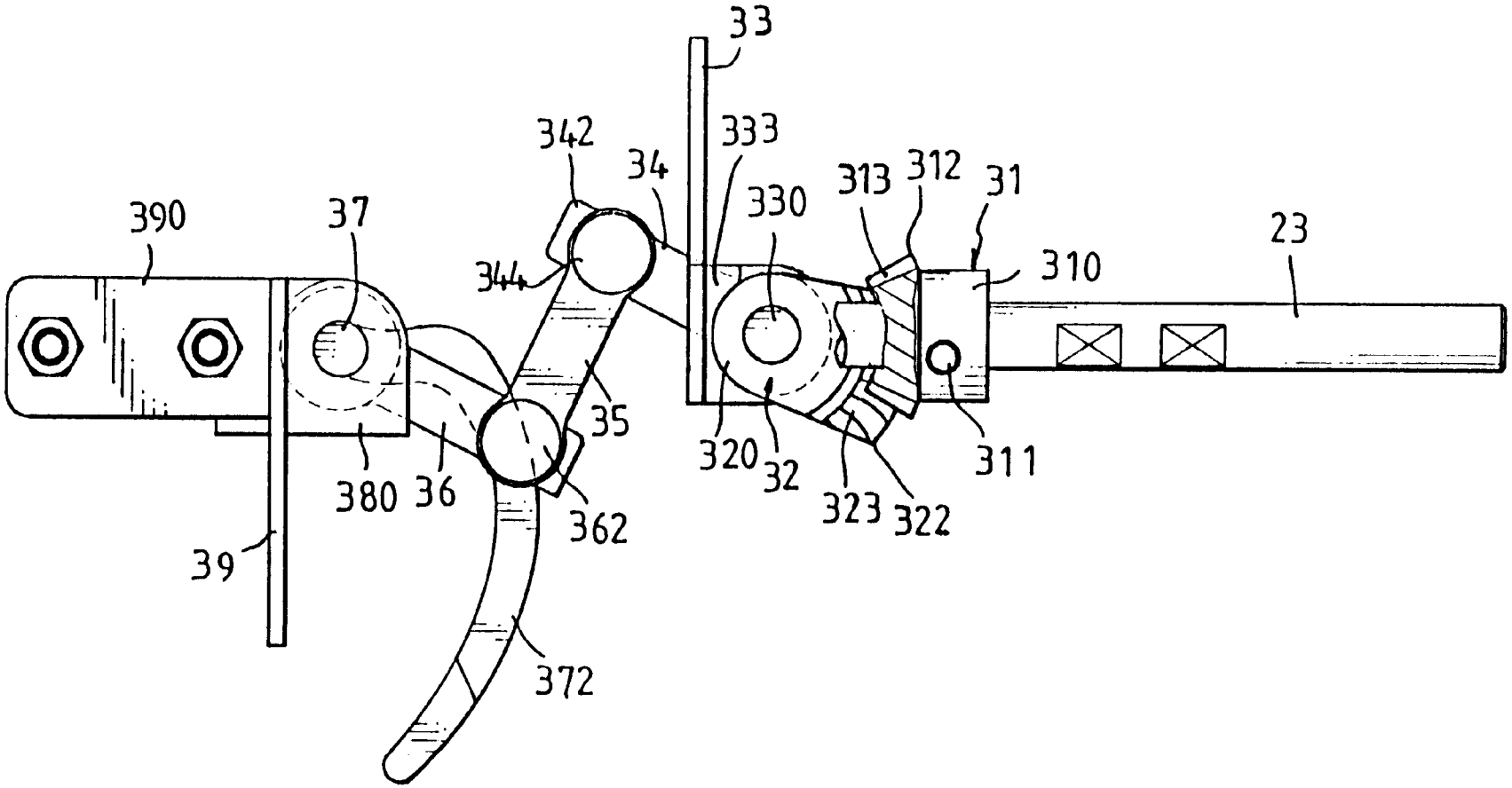
FIGS. 5 and 6 are top views illustrating the operation of the driving mechanism.
Figure 6:
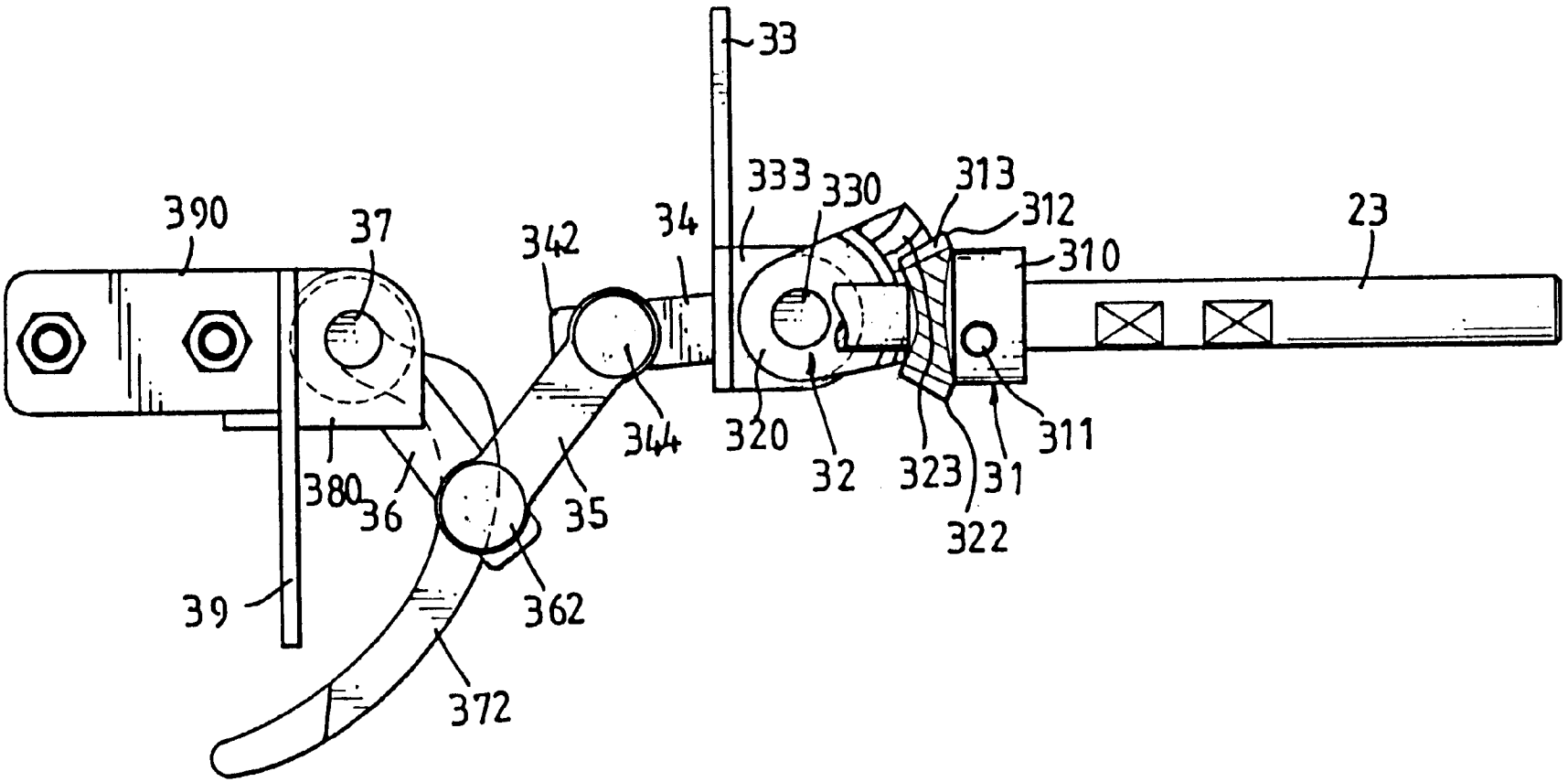

A frame 38 has one end 381 secured to a lower portion 390 of a wall member 39 of the sewing machine 10 by one or more fasteners 391 and includes the other end having a pair of flanges 380 for rotatably supporting a vertical axle 37. The wall member 39 may be a portion of the arm 11 of the sewing machine 10 or may be attached to the arm 11 by one or more fasteners. A rotary looper 372 is secured to a block 371 which is secured to the axle 37 by one or more fasteners 370, for allowing the rotary looper 372 to be rotated in concert with the axle 37. A stick 36 has one end 363 secured to the axle 37 by a fastener 364 and has the other end 360 secured to a pin 362 by a fastener 361. A link 35 has two ends 350 pivotally coupled to the pins 344, 362 for pivotally coupling the rod 330 to the axle 37 and for allowing the rotary looper 372 to be rotated by the driving shaft 23 via the bevel gears 31, 32 and the rod 330 and the follower 34 and the link 35 and the stick 36 and the axle 37, best shown in FIGS. 5 and 6.

Referring next to FIG. 8, the thread 80 may be moved laterally, by the rotary looper 372, across the threads 82 that are actuated by the needles 25 for forming different stitches. Alternatively, the driving shaft 23 may be stably and fixedly secured in the sewing machine. The bevel gear 31 and the bar 24 may be rotatably secured on the shaft 23 and coupled to the beam 21 for allowing the bevel gear 31 and the bar 24 to be rotated directly by the spindle 12 via the beam 21.

It is to be noted that the needles 25 are directly driven by the driving shaft 23 which is also coupled to the rotary looper 372 for rotating the rotary looper 372 about the vertical axle 37, such that both the needles 25 and the rotary looper 372 are driven by the driving shaft 23 simultaneously, such that the operating timing of the needles 25 and the rotary looper 372 may be easily calibrated.

Accordingly, the rotary looper driving mechanism in accordance with the present invention includes a driving shaft that may be used for simultaneously driving the needles and the rotary looper.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving mechanism for a sewing machine, said driving mechanism being disposed in an arm of the sewing machine, said driving mechanism comprising:

a shaft rotatable secured in the arm of the sewing machine, at least one needle slidably secured in the arm and adapted to be moved upward and downward, a rotary looser rotatably coupled to the sewing machine at a vertical axle, said rotary looper being rotatable about said axle, a first coupling means for coupling said at least one needle to said shaft, for moving said at least one needle upward and downward, and a second coupling means for coupling said rotary looper to said shaft, for rotating said shaft about said axle, said second coupling means including a frame secured to the sewing machine for rotatably supporting said axle, a rod vertically and rotatably secured to the sewing machine, a third coupling means for coupling said rod to said axle, and means for rotating said rod, said rotary looper being rotated by said rotating means via said rod and said third coupling means, said at least one needle and said rotary looper being allowed to be actuated by said shaft simultaneously, said third coupling means including a follower secured to said rod and rotated in concert with said rod, a stick secured to said axle, and a link pivotally coupling said follower to said stick for allowing said axle to be actuated by said rod.

2. A driving mechanism for a sewing machine, said driving mechanism being disposed in an arm of the sewing machine, said driving mechanism comprising:

a shaft rotatable secured in the arm of the sewing machine, at least one needle slidably secured in the arm and adapted to be moved upward and downward, a rotary looper rotatably coupled to the sewing machine at a vertical axle, said rotary looper being rotatable about said axle, a first coupling means for coupling said at least one needle to said shaft, for moving said at least one needle upward and downward, and a second coupling means for coupling said rotary looper to said shaft, for rotating said shaft about said axle, said second coupling means including a frame secured to the sewing machine for rotatably supporting said axle, a rod vertically and rotatably secured to the sewing machine, a third coupling means for coupling said rod to said axle, and means for rotating said rod, said rotary looper being rotated by said rotating means via said rod and said third coupling mean, said at least one needle and said rotary looper being allowed to be actuated by said shaft simultaneously, said rotating means including a first bevel gear secured to said rod, and a second bevel gear secured to said shaft and engaged with said first bevel gear, for allowing said rod to be rotated by said shaft via said first bevel gear and said second bevel gear.

* * * * *